US011851298B2

(12) United States Patent
Mariani et al.

(10) Patent No.: US 11,851,298 B2
(45) Date of Patent: Dec. 26, 2023

(54) MACHINE FOR PRODUCING CARDBOARD

(71) Applicant: Renova s.r.l., Sesto San Giovanni (IT)

(72) Inventors: Marco Mariani, Sesto San Giovanni (IT); Ugo Re, Sesto San Giovanni (IT)

(73) Assignee: Renova S.R.L., Milan (IT)

( * ) Notice: Subject to any disclaimer, the term of this patent is extended or adjusted under 35 U.S.C. 154(b) by 306 days.

(21) Appl. No.: 17/333,429

(22) Filed: May 28, 2021

(65) Prior Publication Data

US 2022/0380160 A1 Dec. 1, 2022

(51) Int. Cl.

| | |
|---|---|
| ***B65H 23/182*** | (2006.01) |
| ***B65H 26/08*** | (2006.01) |
| ***B65H 16/02*** | (2006.01) |
| ***B65H 16/10*** | (2006.01) |
| ***B65H 16/06*** | (2006.01) |

(Continued)

(52) U.S. Cl.

CPC ..... *B65H 23/1825* (2013.01); *B65H 16/02* (2013.01); *B65H 16/06* (2013.01); *B65H 16/103* (2013.01); *B65H 23/06* (2013.01); *B65H 23/066* (2013.01); *B65H 23/185* (2013.01);

(Continued)

(58) Field of Classification Search

CPC ..... B65H 16/02; B65H 16/04; B65H 16/06; B65H 16/10; B65H 16/103; B65H 19/10; B65H 19/12; B65H 19/123; B65H 19/126; B65H 19/1857; B65H 19/1873; B65H 19/1878; B65H 19/1889; B65H 23/005; B65H 23/044; B65H 23/06; B65H 23/063; B65H 23/066; B65H 23/182; B65H 23/1825; B65H 23/185; B65H 26/08; B65H 2403/725; B65H 2403/7253; B65H 2403/7254; B65H 2403/7255; B65H 75/30; B65H 75/4436; B65H 75/4442; B65H 75/4444; B65H 75/4447

See application file for complete search history.

(56) References Cited

U.S. PATENT DOCUMENTS 3,822,838 A * 7/1974 Butler, Jr. ..... B65H 19/14 242/421.7
3,949,949 A * 4/1976 Thompson ..... B65H 23/063 242/421

(Continued)

FOREIGN PATENT DOCUMENTS

CN 107010439 A * 8/2017 ..... B65H 16/06
WO WO-9107341 A1 * 5/1991 ..... B65H 23/1825

*Primary Examiner* — Michael R Mansen
*Assistant Examiner* — Raveen J Dias
(74) *Attorney, Agent, or Firm* — MacMillan, Sobanski & Todd, LLC

(57) ABSTRACT

The present invention relates to a machine for producing multi-layer cardboard or paper, or a machine for either printing or converting, starting from a reel of paper, cardboard or other material. In general, the invention can be applied to machines wherein a reel of different materials is unwound and which requires a contrast system to regulate the tensioning of the ribbon. In particular, the invention relates to a system for braking said reel.

In particular, the invention relates to a braking system (2) for a support member (1) of a reel (B), for example, a reel of paper in a machine for producing cardboard or corrugated cardboard, wherein said braking system (2) comprises a motor-generator device (8) and a mechanical brake device (9) arranged coaxially.

13 Claims, 2 Drawing Sheets

(51) Int. Cl.
*B65H 23/185* (2006.01)
*B65H 23/06* (2006.01)

(52) U.S. Cl.
CPC ..... *B65H 26/08* (2013.01); *B65H 2403/7253* (2013.01); *B65H 2403/7254* (2013.01)

(56) References Cited

U.S. PATENT DOCUMENTS 4,844,371 A * 7/1989 Tahara ..... B65H 23/063 242/423.2
4,915,319 A * 4/1990 Gerber ..... G01D 15/28 242/596.4
5,025,998 A * 6/1991 Hutzenlaub ..... B65H 16/06 242/596.1
5,467,934 A * 11/1995 del Mar Segura Salvador ..... B65H 59/381 242/421.4
5,503,349 A * 4/1996 Chertok ..... B65H 23/063 242/422.2
5,758,841 A * 6/1998 Ayffre ..... B65H 75/245 242/571.5
5,775,630 A * 7/1998 Hogberg ..... B65H 19/1868 242/554.6
5,860,617 A * 1/1999 Bolza-Schunemann ..... B65H 16/10 242/596.5
5,967,445 A * 10/1999 Yuyama ..... B65H 16/04 242/597.6
6,386,477 B1 * 5/2002 Kaufmann ..... B65H 19/1821 242/555.3
7,496,983 B2 * 3/2009 Kostigian ..... B08B 1/04 15/40
7,540,447 B2 * 6/2009 Shiraishi ..... B65H 23/06 242/421.7
9,663,315 B2 * 5/2017 Hashikawa ..... B65H 20/12
9,783,385 B2 * 10/2017 Lefebvre ..... B65H 23/044
11,365,077 B2 * 6/2022 Adami ..... B65H 16/023
2004/0200922 A1 * 10/2004 Nakamura ..... B65H 16/06 242/559.2
2005/0242224 A1 * 11/2005 Shiraishi ..... B65H 23/06 242/421.7
2006/0266869 A1 * 11/2006 Quittkat ..... B65H 16/103 242/412.3
2007/0170299 A1 * 7/2007 Ritter ..... B65H 18/10 242/533.6
2008/0135669 A1 * 6/2008 Kostigian ..... B08B 1/00 242/557
2009/0072073 A1 * 3/2009 Campbell ..... B65H 16/04 242/597
2012/0073249 A1 * 3/2012 Pryor ..... B65H 23/1825 53/514
2013/0047554 A1 * 2/2013 Bertram ..... B65H 75/30 156/60
2015/0102153 A1 * 4/2015 Hashikawa ..... B65H 23/245 242/419.9
2015/0115527 A1 * 4/2015 Takematsu ..... G03G 15/6573 271/265.01
2016/0046458 A1 * 2/2016 Lefebvre ..... G01L 3/10 242/534
2016/0167911 A1 * 6/2016 Chretien ..... B65H 23/063 242/421
2017/0102014 A1 * 4/2017 Re ..... B21C 47/30
2017/0267001 A1 * 9/2017 Hayashi ..... B65H 23/1825
2020/0391968 A1 * 12/2020 Adami ..... B65H 23/06

* cited by examiner

MACHINE FOR PRODUCING CARDBOARD

FIELD OF THE INVENTION

The present invention relates to a machine for producing multi-layer cardboard or paper, or a machine for printing or a machine in the converting sector, starting from a reel of paper or other material. In general, the invention can be applied to machines wherein a reel of different materials is unwound and which requires a contrast system to regulate the tensioning of the ribbon. In particular, the invention relates to a system for braking said reel.

BACKGROUND ART

By way of example, machines for producing multi-layer cardboard, for example, corrugated cardboard, typically comprise systems for unwinding paper from special reels, systems for corrugating the intermediate layer and systems for coupling and gluing the various layers.

The reels of paper used for the different layers are normally large and therefore have an elevated weight. To prevent the uncontrolled unwinding of paper from such reels and to regulate the tensioning thereof correctly, braking systems are consequently comprised, which can be both mechanical (for example, caliper brakes) and pneumatic or of the motor-brake or electromagnetic powder brake type.

The mechanical brake has the drawback of transforming the kinetic energy, through friction, into thermal energy, which is lost by dissipation into the external environment.

Whereas, the motor-brake has the drawback of having elevated dimensions, being costly and, in the launching and rewinding steps, having high energy consumption, characteristics necessary for implementing an adequate braking action for a large reel of paper.

Therefore, the problem underlying the present invention is to provide a braking system, which reduces energy consumption and dispersion of energy into the environment, which has reduced dimensions and which can be integrated into machines for unwinding reels, which are already installed.

SUMMARY OF THE INVENTION

Such problem is overcome by a braking system for reels as defined in the attached claims, the definitions of which form an integral part of the present description.

Further features and advantages of the present invention will be more apparent from the description of embodiments, given here below by way of a non-limiting example.

DETAILED DESCRIPTION OF THE INVENTION

Figure 1:
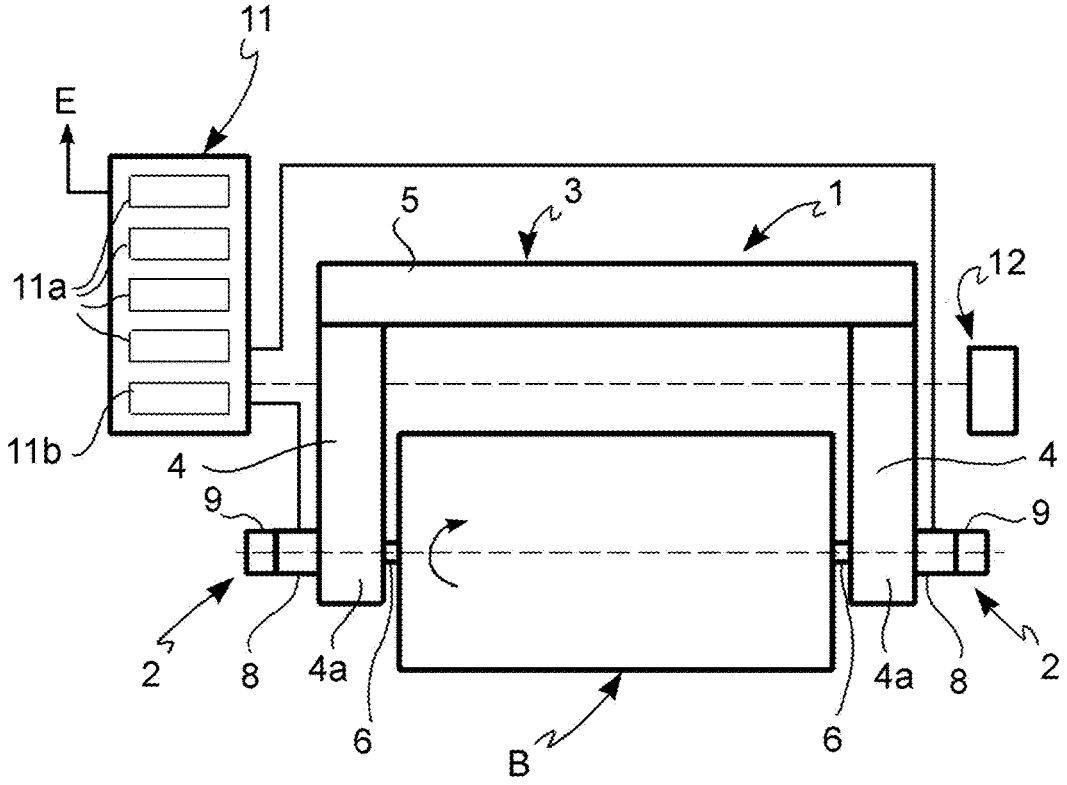
FIG. 1 depicts a schematic view from above of the support member of a reel provided with the braking system according to the invention.

FIG. 1 shows a support member 1 of a reel B of paper on which the braking system 2 of the invention is installed.

The support member 1, in the example shown in the figures, is part of a machine (not shown) for producing cardboard, in particular, for producing corrugated cardboard, which will comprise, downstream of the support member 1, a system for coupling several layers of paper and a pulling system for unwinding the paper from the reel B. The reel B, pulled to rotate by said pulling system during the production step, therefore supplies a drive torque, which must be regulated by means of contrast with the braking system 2 so as to ensure the necessary tensioning of the paper for a correct unrolling of the same.

The support member 1, commonly referred to as "roll-stand", comprises a C-shaped structure 3 having two arms 4 and a connection bar 5. The distal ends 4*a* of the arms 4 support respective shafts 6, which rotationally support the reel B at the two proximal ends 6*a* thereof. Whereas, the braking system 2 is assembled at the distal ends 6*b* of the shafts 6, by means of lap joint, for example.

Figure 2:
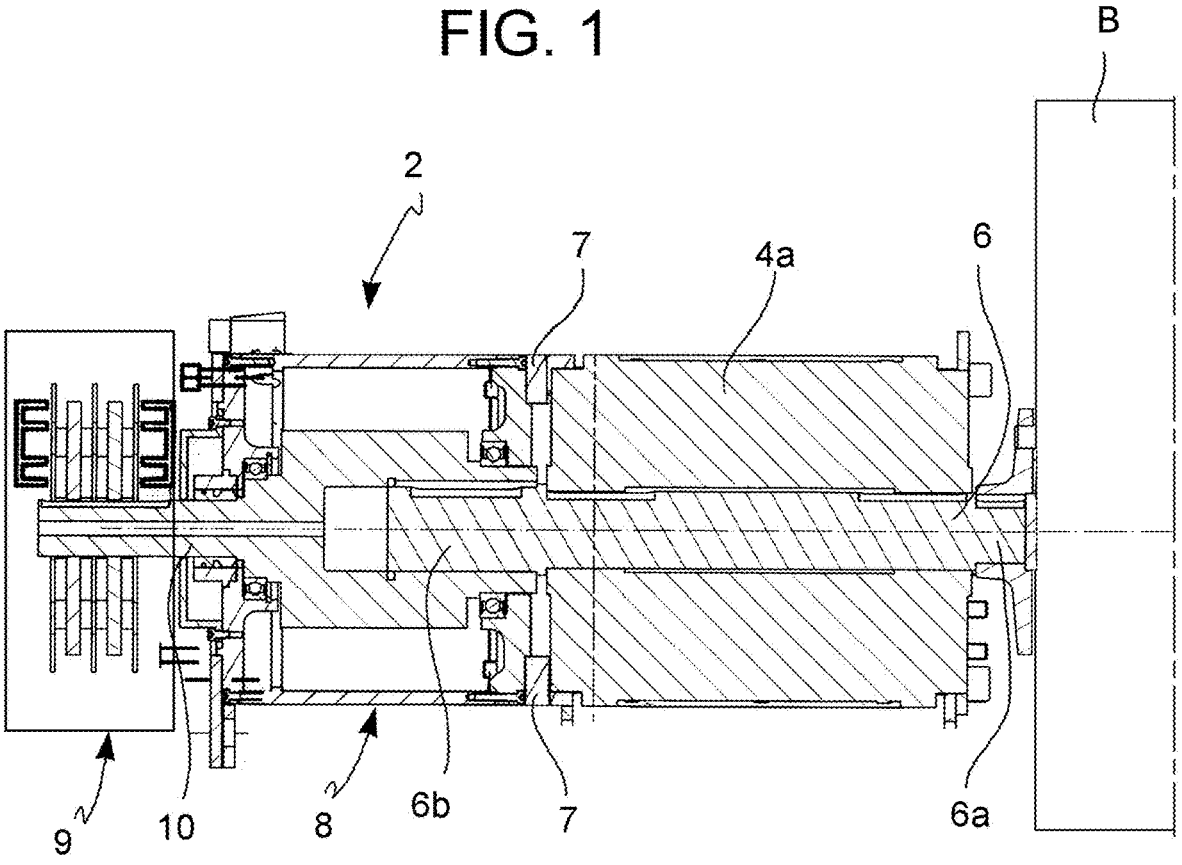
FIG. 2 depicts a vertical section of a detail of the support member in FIG. 1 showing the braking system of the invention.

As shown in FIG. 2, the braking system 2 is coupled to the support member 1, for example, by means of a flange coupling 7.

The braking system 2 of the invention comprises a motor-generator device 8 and a mechanical brake device 9, arranged coaxially. Preferably, the mechanical brake device 9 is assembled and therefore acts on the same shaft 10 as the motor-generator device 8.

The distal end 6*b* of the shaft 6 protrudes outside the distal end 4*a* of the respective arm 4 and is fastened coaxially inside the shaft 10 of the motor-generator device 8.

The motor-generator device 8 is an electric motor, which, by means of the interface with an inverter, can supply, depending on the case (which will be described further below) a driving torque or load torque, producing electricity in this latter case.

The motor-generator device 8 is undersized with respect to the braking needs of the unwinding of the reel B, especially when the latter is at the start of the unwinding and therefore has an elevated inertial mass. This allows the size and cost of the motor-generator device 8 to be limited with respect to known braking systems, which use only one motor braking system.

Preferably, the mechanical brake device 9 is a single or multi-disk disk brake (a double disk is shown in the figure), preferably of the pneumatic type.

For safety reasons, the mechanical brake device 9 is sized for a complete braking of the unwinding of the reel B, so as to intervene also in the case of emergency braking. However, in normal operating conditions, it is actuated splitting the braking torque between it and the motor-generator device 8. In this way, a partial recovery of energy is obtained in the form of electricity, unlike the known braking systems, which use only one mechanical brake and in which all of the energy deriving from the friction is released into the environment in the form of thermal energy.

As shown in FIG. 1, the braking system 2 of the invention comprises a command and control unit 11 and a user interface 12 for displaying the operating parameters.

Typically, a machine for producing cardboard comprises two support members 1, which act alternately and which are designed to prevent a machine stop when a reel B is nearly finished and needs to be replaced with a new reel B. Whereas, the arrangement of two support members 1 with the relative reels B allows a quick joining of the ribbon of paper being processed with a new reel B when the reel B on the other support member 1 is almost finished.

Therefore, the method of producing cardboard comprises the following steps:

start-up of the machine;

production step at controlled speed and tensioning;

replacement of an almost empty reel B with a new reel B.

As stated above, the motor-generator device 8 can act both as a motor, i.e. supplying a drive torque, and as a generator, i.e. supplying a braking torque. In particular, the motor-generator device 8 acts as a motor in the start-up step (called reel launch step), in conjunction with the pulling system so as to overcome the resistance due to the inertial mass of the reel B, and in the step of replacing the reel, so as to rewind the remaining ribbon of paper after the cutting and joining of the new reel B. Vice versa, the motor-generator device 8 acts as a generator during the normal production step of the machine.

Therefore, the command and control unit 11 is configured to command the operation of four braking systems 2, i.e. two braking systems 2 for each of the two support members 1, and for sending the electricity produced by the motor-generator device 8 to the power supply network E during the operational step. Preferably, the command and control unit 11 comprises four circuit boards 11*a* for commanding the braking action and a circuit board 11*b* for managing the sending of the electricity produced to the power supply network E.

In other embodiments, each reel will comprise only one braking system 2, so the command and control unit 11 will comprise only two circuit boards 11*a* for controlling the braking action.

In particular, according to a first embodiment, the command and control unit 11 is configured to perform the following operations:

i) receiving the machine parameter values of line speed, paper tension, diameter of reel B and number of turns of the reel B;

ii) comparing said machine parameter values with pre-set values;

iii) calculating the braking torque CL of the braking system 2 to be supplied;

iv) calculating the splitting of the braking torque CL between the braking torque CM of the motor-generator device 8 and the braking torque CF of the mechanical brake device 9;

v) commanding the motor-generator device 8 and the mechanical brake device 9 according to the calculation of step iv) for supplying the calculated braking torques CM and CF;

vi) managing, by means of the interface with an inverter, the electricity produced by the motor-generator device 8 and sending said electricity to the power supply network E.

Step i) is carried out by means of opportune machine sensors, for example, a photocell sensor for monitoring the diameter of the reel B. The motor-generator device 8 is further provided with a "resolver" or "encoder" for reading the number of turns of the shaft 10. The pulling force of the line is detected by means of a jumper or by means of load cells.

Step iv) is carried out in the following way:

a) when CL>CM-MAX, where CM-MAX is the maximum braking torque which can be supplied by the motor-generator device 8, CL is given by the sum CM-MAX+CF;

b) when CL<CM-MAX, CL is given by the sum of CM+CF, where CF=mCL and CM=nCL, where m=1−n and n is from 0.9 to 0.99 and is preferably about 0.95;

c) in the event of emergency braking, CL=CM-MAX+CF-MAX, where CF-MAX is the maximum braking torque which can be supplied by the mechanical brake device 9.

Such an operating sequence allows the recovery of energy to be sent to the power supply network E to be optimized, keeping the braking torque supplied by the motor-generator device 8 as elevated as possible. In fact, when the required braking torque CL is greater than CM-MAX the difference will be given by the mechanical brake device 9. Vice versa, when CL is smaller than CM-MAX, a situation which arises typically when the reel B is almost empty—so the inertial mass thereof decreases significantly—or when the reel B itself is wrapped with light paper, it is necessary to keep the mechanical brake device 9 activated to have quick reaction times in the event of emergency braking and to ensure a management of the supply of the braking torque by means of feedback action. Therefore, the mechanical brake device 9 will contribute by a percentage from 1% to 10% to the required braking torque CL.

When the mechanical brake device 9 is a pneumatic disk brake, step v) of commanding the mechanical brake device 9 is carried out by adjusting the air pressure of the pneumatic disk brake by means of an electric signal transducer into pneumatic pressure.

Figure 3:
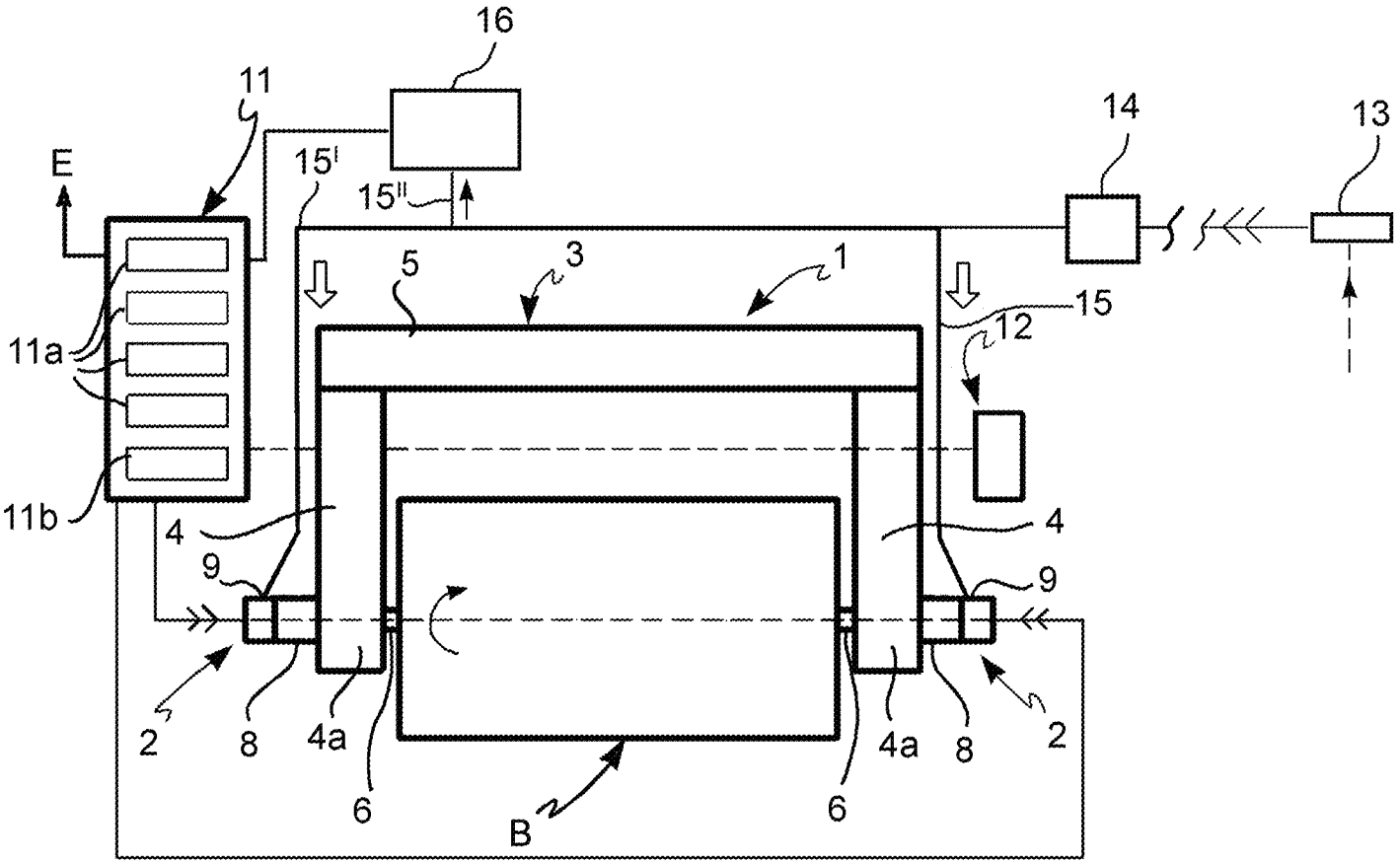
FIG. 3 depicts a schematic view from above of the support member of a reel provided with the braking system according to the invention according to a different embodiment.

FIG. 3 shows a different embodiment of the braking system of the invention, which is particularly adapted to be integrated into cardboard producing machines, which are already provided with a pneumatic type braking system.

As in the previous embodiment, the pulling force of the line is detected in real time by means of a detection device 13, such as a jumper or a load cell.

The device 13 sends an electric signal to an electro-pneumatic converter (EP converter) 14, which commands the pressure of the air, which is sent, along the lines 15, 15', to the mechanical brake devices (pneumatic) 9, for generating the necessary braking torque to ensure the preset tension value. It should be noted that the configuration described thus far is typical of a roll-stand with a conventional air brake.

The system of the invention comprises the arrangement of a shunt 15" of the pneumatic line 15, 15' operatively connected to a pressure transducer 16, which reads the air pressure along the line 15, 15' and translates it into an electric signal, which is sent to the command and control unit 11, which, by means of the previously described algorithm in step iv), calculates the braking torque and sends a command signal to the motor-generator device 8.

Clearly, in this way the total braking torque will be greater than what is actually requested, so the detection device 13 will detect a tension greater than the tension requested and, as a result, the electro-pneumatic converter 14 will regulate the air pressure. A quick repetitive adjustment cycle is established, which allows the equilibrium to be achieved in fractions of a second, supplying the necessary braking torque CL split, as described above, between CM and CF.

Consequently, according to such embodiment, the braking system 2 comprises:

a detection device 13 configured for detecting, in real time, the tension applied to the paper unwound from a reel B;

an electro-pneumatic converter 14 operatively connected to said detection device 13, the electro-pneumatic converter 14 being configured to regulate the pressure of air to be sent to said mechanical brake device 9 according to a preset braking torque value CL to be supplied;

at least one pneumatic line 15, 15' connected to said electro-pneumatic converter 14 and to said mechanical brake device 9;

a pressure transducer 16 connected, by means of a shunt 15", to said at least one pneumatic line 15, 15' and to a command and control unit 11, wherein said command and control unit 11 calculates a splitting of the preset braking torque CL to be supplied between a braking torque CF of the mechanical brake device 9 and a braking torque CM of the motor-generator device 8 according to the pressure detected by the pressure transducer 16 and it commands the braking torque CM of the motor-generator device 8 according to said calculation.

The command and control unit 11 is configured to perform the following operations:

i) receiving, by means of a pressure transducer 16, the air pressure values supplied along the line 15, 15' from said electro-pneumatic converter 14;

ii) calculating the splitting of the braking torque CL between the braking torque CM of the motor-generator device 8 and the braking torque CF of the mechanical brake device 9 according to said pressure values received and the preset braking torque CL to be supplied;

iii) commanding the motor-generator device 8 according to the calculation of step ii) for supplying the calculated braking torques CM and CF;

iv) repeating steps i)-iii) until reaching a braking torque CL equal to the preset braking torque CL;

v) managing, by means of the interface with an inverter, the electricity produced by the motor-generator device 8 and sending said electricity to the power supply network E.

Therefore, the braking system 2 of the invention achieves the predetermined objects.

In fact, such braking system can also be integrated into machines already in use, having an air brake, simply by replacing the latter with the braking system 2, or, in the case of replacing a motor brake or a magnetic brake, providing a pressurized air supply. In the case of the second embodiment described above, besides replacing the air brake with the coaxial motor-generator device 8 and the mechanical brake device 9, it will suffice to connect the pneumatic lines 15, 15' to the pressure transducer 16 by means of the shunt 15" and the pressure transducer 16 to the command and control unit 11, which commands the motor-generator device 8.

The braking system of the invention has reduced dimensions and a contained cost, also due to the fact that the contemporary use of a mechanical brake does not require a motor-generator with elevated power.

The braking system 2 also allows a recovery of electricity, although only partial (i.e. relating only to the braking torque part supplied by the motor generator device 9).

Clearly only a few particular embodiments of the present invention have been described, so an expert skilled in the art will be able to make all of the necessary changes for the adaptation thereof to particular applications, without thereby departing from the scope of protection of the present invention.

What we claim is:

1. A braking system for a support member of a reel, wherein said braking system comprises a motor-generator device and a mechanical brake device arranged coaxially:

comprising a command and control unit configured to perform the following operations:

i) receiving the machine parameter values of line speed, paper tension, diameter of the reel and number of turns of the reel;

ii) comparing said machine parameter values with pre-set values;

iii) calculating a braking torque CL of the braking system to be supplied;

iv) calculating the splitting of the braking torque CL between a braking torque CM of the motor-generator device and a braking torque CF of the mechanical brake device;

v) commanding the motor-generator device and the mechanical brake device according to the calculation of step iv) for supplying the calculated braking torques CM and CF;

vi) managing the electricity produced by the motor-generator device (8) and sending said electricity to a power supply network (E).

2. The braking system according to claim 1, wherein the mechanical brake device is mounted to the same shaft as the motor-generator device.

3. The braking system according to claim 1, wherein the motor-generator device is an electric motor which is configured to supply a drive torque or load torque, producing, in the latter case, electricity.

4. The braking system according to claim 1, wherein the mechanical brake device is a mono- or multi-disk brake, preferably of the pneumatic type.

5. The braking system according to claim 1, wherein step i) is carried out by means of suitable sensors, including a photocell sensor for monitoring the diameter of the reel, a "resolver" or "encoder" of the motor-generator device for reading the number of turns of the shaft, and a jumper or load cells for detecting a pulling force of paper being unwound from the reel.

6. The braking system according to claim 1, wherein step iv) is carried out as follows:

a) when CL>CM-MAX, where CM-MAX is a maximum braking torque which can be supplied by the motor-generator device, CL is given by the sum CM-MAX+CF;

b) when CL<CM-MAX, CL is given by the sum of CM+CF, where CF=mCL and CM=nCL, where m=1-n and n is from 0.9 to 0.99;

c) in the event of emergency braking, CL=CM-MAX+CF-MAX, where CF-MAX is a maximum braking torque which can be supplied by the mechanical brake device.

7. The braking system according to claim 1, wherein, when the mechanical brake device is a pneumatic disk brake, step v) of commanding the mechanical brake device is carried out by adjusting the air pressure of the pneumatic disk brake by means of an electric signal transducer into pneumatic pressure.

8. A braking system for a support member of a reel, wherein said braking system comprises a motor-generator device and a mechanical brake device arranged coaxially;

wherein said mechanical brake device is an air brake, comprising:

a detection device configured to detect, in real time, a tension applied to paper unwound from the reel;

an electro-pneumatic converter operatively connected to said detection device, the electro-pneumatic converter being configured to regulate the air pressure to be sent to said mechanical brake device according to a preset braking torque value CL to be supplied;

at least one pneumatic line connected to said electro-pneumatic converter and to said mechanical brake device;

a pressure transducer connected, by means of a shunt, to said at least one pneumatic line and to a command and control unit, wherein said command and control unit calculates a splitting of the preset braking torque value CL to be supplied between a braking torque CF of the mechanical brake device and a braking torque CM of the motor-generator device according to the air pressure detected by the pressure transducer and it commands the braking torque CM of the motor-generator device according to said calculation.

9. The braking system according to claim 8, wherein said command and control unit is configured to perform the following operations:

i) receiving, by means of the pressure transducer, pressure values of the air pressure supplied along said at least one pneumatic line from said electro-pneumatic converter;

ii) calculating the splitting of the preset braking torque value CL between the braking torque CM of the motor-generator device and the braking torque CF of the mechanical brake device according to said pressure values received and the preset braking torque value CL to be supplied, wherein said calculation is carried out using an algorithm, which comprises the following steps:

a) when CL>CM-MAX, where CM-MAX is a maximum braking torque which can be supplied by the motor-generator device, CL is given by the sum CM-MAX+CF;

b) when CL<CM-MAX, CL is given by the sum of CM+CF, where CF=mCL and CM=nCL, where m=1-n and n is from 0.9 to 0.99;

c) in the case of emergency braking, CL=CM-MAX+CF-MAX, where CF-MAX is a maximum braking torque which can be supplied by the mechanical brake device;

iii) commanding the motor-generator device according to the calculation of step ii) for supplying the calculated braking torques CM and CF;

iv) repeating steps i)-iii) until reaching a braking torque value CL equal to the preset braking torque value CL;

v) managing the electricity produced by the motor-generator device and sending said electricity to a power supply network.

10. A machine comprising at least one support member of a reel of paper or other material, wherein said at least one support member comprises a C-shaped structure having two arms and a connection bar, wherein distal ends of the arms support respective shafts, which rotationally support the reel at two proximal ends thereof, a braking system according to claim 8 being mounted at distal ends of the shafts.

11. The machine according to claim 10, wherein the distal ends of each shaft protrude outside the distal ends of each respective arm and is fastened coaxially inside a shaft of the motor-generator device.

12. The machine according to claim 10, the at least one support member including two support members, wherein a command and control unit of the braking system is configured to command the operation of two braking systems for each of the two support members, and to send the electricity produced by a motor-generator device of the braking system to a power supply network.

13. A method for producing cardboard or corrugated cardboard, for either printing or converting, comprising the steps of:

providing a machine comprising at least one support member of a reel of paper or other material, wherein said support member comprises a C-shaped structure having two arms and a connection bar, wherein distal ends of the arms support respective shafts, which rotationally support the reel at two proximal ends thereof, a braking system according to claim 9 being mounted at distal ends of the shafts;

start-up of the machine;

production of paper or other material at controlled unwinding and tensioning speed;

replacement of an almost empty reel with a new reel, wherein a motor-generator device of the braking system acts both as a motor at the start-up and when replacing the reel and as a generator during the production.

* * * * *